United States Patent [19]

Halberstadt et al.

[11] Patent Number: 4,710,677

[45] Date of Patent: Dec. 1, 1987

[54] INCANDESCENT LAMPS

[75] Inventors: Alex L. Halberstadt, London; Roger A. Hume, Melton Mowbray, both of England

[73] Assignee: Thorn Emi plc, London, England

[21] Appl. No.: 636,990

[22] Filed: Aug. 2, 1984

[30] Foreign Application Priority Data

Aug. 2, 1983 [GB] United Kingdom ..... 8320639

[51] Int. Cl.[4] ..... H01K 1/26

[52] U.S. Cl. ..... 313/580; 313/579; 313/116

[58] Field of Search ..... 313/113, 579, 580, 116

[56] References Cited

U.S. PATENT DOCUMENTS

| | | | |
|---|---|---|---|
| 2,063,929 | 12/1936 | Hutaff et al. | 313/113 |
| 2,158,561 | 5/1939 | Biggs | 313/113 |
| 2,181,295 | 11/1939 | Biggs et al. | 313/113 |
| 2,405,261 | 8/1946 | Levi et al. | 313/116 |
| 2,509,071 | 5/1950 | Pennybacker | 313/113 |
| 2,775,718 | 12/1956 | Dubilier | 313/116 |
| 3,536,946 | 10/1970 | Kopelman et al. | 313/113 |
| 3,842,306 | 10/1974 | Henderson et al. | 313/116 |
| 3,931,536 | 1/1976 | Fohl et al. | 313/116 |
| 4,079,288 | 3/1978 | Maloney et al. | 313/113 |

FOREIGN PATENT DOCUMENTS

| | | |
|---|---|---|
| 693416 | 7/1953 | United Kingdom . |
| 740096 | 11/1955 | United Kingdom . |
| 1540892 | 2/1979 | United Kingdom . |
| 1565373 | 4/1980 | United Kingdom . |
| 2066561B | 7/1981 | United Kingdom . |
| 1602771 | 11/1981 | United Kingdom . |

*Primary Examiner*—David K. Moore

*Attorney, Agent, or Firm*—Fleit, Jacobson, Cohn & Price

[57] ABSTRACT

An incandescent lamp, which emits infra-red radiation, comprises a tubular quartz envelope, within which a tungsten filament is supported. To reflect radiation, which is emitted in a downward direction from the filament, back in an upward direction to an item to be heated, a substantially pure aluminum oxide coating is bonded in a substantially permanent manner to the surface of the envelope. The coating extends subtantially along the length of the lamp and around approximately half of the cross-sectional circumference thereof. The coating is applied to the envelope by a spray gun technique, wherein finely divided aluminum powder is blown through an oxygenated flame, which is directed towards an area of the envelope to be coated.

6 Claims, 2 Drawing Figures

INCANDESCENT LAMPS

FIELD OF THE INVENTION

This invention relates to incandescent lamps and in particular, though not exclusively to infra-red emitting, tungsten-halogen lamps, for example of the kind described and claimed in our co-pending European Application No. 84301636.1.

DESCRIPTION OF THE RELATED ART

Lamps of this type, wherein a tungsten filament, which emits infra-red radiation, is supported within a generally tubular envelope fabricated from quartz or an alternative high silica content material, may be used in such applications as domestic cookers, paint dryers and space heaters, for example.

To maximise the amount of radiation available for use, the lamps require an efficient reflector behind the filament, which can operate at temperatures of 2000K. to 2600K. The reflector may be external to the lamp, as part of the fitting within which the lamp operates, or it may be preferable in many applications to employ a reflector in the form of a coating of a suitable reflective material, which is applied to an area of the surface of the quartz envelope of the lamp. However, at the high operating temperatures of the lamp, conventional reflective coatings, such as aluminium or gold, may rapidly disintegrate.

A known technique for producing a reflective coating on the surface of a quartz envelope consists of bonding a layer of high melting point powdered substance, such as aluminium oxide, to the quartz surface by fusion with an inorganic binding agent, such as lead borate.

However, such binding agents tend to possess a coefficient of thermal expansion which differs from that of quartz, so that surface strains are set up on the quartz envelope during use of the lamp, thereby causing areas of the white reflective coating to fall away from the quartz surface.

Moreover, many inorganic compounds, such as lead borate, zinc oxide and titanium dioxide, which may be suitable binding agents, may discolour, either reversibly or irreversibly, on heating, thereby lowering substantially the efficiency of the coating during operation of the lamp.

Another technique is disclosed in UK Pat. No. 740,096, wherein a coating of a fluorescent powder is applied to the inner surface of a glass bulb by a whirling effect produced by a stream of air or oxygen and subsequent passage of the powder through a flame, so that the powder may adhere to the glass surface by electrostatic attraction, for instance.

However, adhesion by this technique may not be regarded as permanent because the applied coating may easily be removed by gentle rubbing with a non-abrasive material, so that such a technique may be considered unsuitable for coatings applied to the outer surface of a glass bulb.

SUMMARY OF THE INVENTION

It is therefore an object of the present invention to provide an incandescent lamp which has a subtantially improved reflective coating applied to the surface thereof and a method of application of the coating thereto.

According to one aspect of the invention there is provided an incandescent lamp comprising a filament enclosed within an envelope fabricated from a material having a substantially high silica content, said envelope having a coating, consisting essentially only of a substantially pure metal oxide, bonded in a substantially permanent manner to an area of the surface thereof, so as to reflect radiation emitted from said filament.

The lamp is preferably a tungsten-halogen lamp, which emits infra-red radiation.

According to a second aspect of the invention there is provided a method of application of a substantially pure metal oxide coating to part at least of the surface of an envelope of an incandescent lamp, said envelope being fabricated from a material of substantially high silica content, said method comprising the step of blowing divided particles of said metal oxide through a flame of oxygenated gas, said flame being directed towards an area of the surface of said envelope to be coated, thereby causing said particles to impinge directly onto the surface of said area, and to be bonded thereto in a substantially permanent manner.

The area of the surface of the envelope to be coated may be initially sand-blasted before the divided particles are blown thereonto, so as to roughen the surface, thereby allowing substantially easier bonding of the particles to the surface.

The area of the surface of the envelope to be coated preferably extends along the length of the lamp, which is preferably tubular, and around approximately half of the cross-sectional circumference thereof.

The coating, when applied to a tubular lamp by the method in accordance with the present invention, may possess a variable thickness which is a maximum in a central region of the area covered by the coating and a minimum in a peripheral region of the area.

BRIEF DESCRIPTION OF THE DRAWINGS

The invention will now be further described by way of example only with reference to the accompanying drawings, wherein.

DETAILED DESCRIPTION

Figure 1:
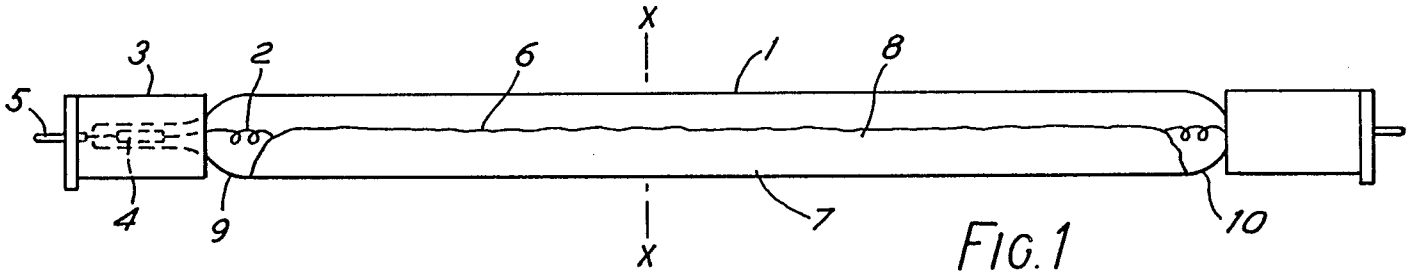
FIG. 1 shows an example of an incandescent lamp, in accordance with the present invention.

FIG. 1 shows an incandescent lamp, which emits infra-red radiation, comprising a tubular quartz envelope 1, which contains halogen gas and within which a tungsten filament 2 is supported.

A ceramic end cap 3 encloses each end of the envelope 1, each end consisting of a pinch seal 4 which connects an electrical connector 5 to a respective end of the filament 2.

The lamp so far described is disclosed in greater detail in our co-pending European Application No. 84301636.1.

However, an efficient reflector is required to reflect infra-red radiation, which is emitted in a generally downward direction, back up to the filament, so that a relatively large proportion of the emitted infra-red radiation is reflected upwardly towards the item to be heated, which may be, for example a cooking utensil when the lamp is employed in a cooking hob, as described in British Application No. 8320717.

One aspect of the invention therefore provides a substantially pure aluminium oxide coating 6 bonded in a substantially permanent manner to the surface of the envelope 1. The coating 6 extends substantially along the length of the lamp and around approximately half of the cross-sectional circumference thereof.

The present meaning of "a substantially pure" aluminium oxide is one which is free from any contaminating substances, such as binding agents.

A second aspect of the invention provides a method of application of the coating to the quartz envelope 1 of the lamp. The method consists of a spray gun technique, wherein finely divided aluminium oxide powder is blown through an oxygenated flame, preferably an oxygenated hydrogen flame, which is directed towards an area of the quartz envelope to be coated, so that the powder impinges directly onto the surface thereof and is caused to bond thereto.

The method, in accordance with the present invention, thus produces a white aluminium oxide coating, which strongly adheres to the quartz envelope and does not disintegrate during use of the lamp. Furthermore, there is no requirement of a binding agent to adhere the coating to the envelope, thereby preventing the white coating from discolouring, either reversibly or irreversibly, as a consequence of temperature changes during use of the lamp.

The temperatures, to which the powder and quartz envelope are subjected, are sufficiently high, i.e. above 2000° C., to melt the aluminium oxide powder and thereby cause it to fuse with the quartz envelope, so as to produce a substantially permanent coating, which cannot be removed, as with coatings applied by known techniques.

Figure 2:
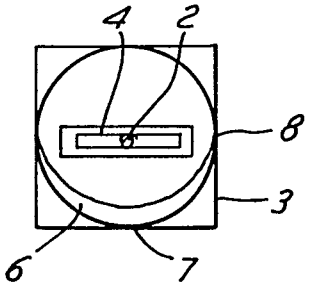
FIG. 2 shows an exploded cross-sectional view along the line X—X in FIG. 1.

A further advantage of the present invention is that the spray gun technique enables a coating, which has a variable thickness, to be applied to the tubular envelope 1, this being shown more clearly in FIG. 2, which shows a cross-sectional view, to an enlarged scale, along the line X—X in FIG. 1. The thickness is a maximum in a central region 7 of the coating 6 and a minimum in a peripheral region 8 thereof, and this physical variation in thickness may further assist in preventing the edges of the coating from peeling off of the surface of the envelope 1.

However, by moving the spray gun, or any other suitable implement which may be employed to spray the coating onto the envelope, in a radial direction relative to the envelope, or by moving the envelope in a radial direction relative to the gun, a coating of substantially even thickness may be obtained.

A relatively thick reflective coating can be built up on the surface of the envelope by repeated application of the aluminmium oxide powder, in accordance with the present invention.

The envelope 1 may be fabricated from alternative materials, having a relatively high silica content, instead of from quartz, as long as they are capable of withstanding, without cracking, the thermal shock of an oxygenated-hydrogen flame impinging directly onto the initially cold surface thereof.

The surface of the envelope 1 may be primarily roughened by sand-blasting before the aluminium oxide powder is applied thereto, so as to aid in adhesion of the powder to the surface.

As an alternative to an oxygenated hydrogen flame, an oxygenated acetylene flame may be employed in the method of applying the coating to the envelope.

The coated area of the envelope may be extended to include ends 9 and 10 of the lamp in the region of the pinch seals, as at 4, thereby substantially reducing the amount of heat to which the pinch seals are subjected, which aids in prolonging the life of the lamp.

The method of application of the coating, in accordance with the present invention, may be used for lamps which operate at higher colour temperatures than 2600K., such as those which emit radiation in the visible spectral range within the temperature range 2600K. to 3400K.

We claim:

1. An incandescent lamp comprising:

an envelope having an exterior surface and being formed from a material having a substantially high silica content;

a filament enclosed within said envelope; and a coating reflective of radiation emitted by said filament and consisting of a layer of a substantially pure metallic oxide containing no binding agent, said layer having been applied whilst in a molten state to an area of said exterior surface, thereby causing said layer to be fused in a substantially permanent manner to said exterior surface without a binding agent, so that, when heated by radiation from said filament, said coating undergoes substantially no discoloration, and wherein said coating possesses a variable thickness which is a maximum in a central region of said area of said exterior surface and a minimum in a peripheral region of said area.

2. A lamp as claimed in claim 1 wherein said substantially pure metal oxide is aluminium oxide.

3. A lamp as claimed in claim 1 wherein said material is quartz.

4. A lamp as claimed in claim 1, wherein said lamp is a tungsten-halogen lamp which emits infra-red radiation.

5. A lamp as claimed in claim 1, wherein said lamp is a generally tubular shape, said area extending substantially along the length thereof and around substantially half of the cross-sectional circumference thereof.

6. A lamp as claimed in claim 1, wherein each end of said lamp consists of a pinch seal with an electrical connection to the respective end of said filament sealed therein, said area including regions of said envelope adjacent to said pinch seals.

* * * * *